US012584480B2

(12) United States Patent
Kay et al.

(10) Patent No.: US 12,584,480 B2
(45) Date of Patent: Mar. 24, 2026

(54) RECIPROCATING PUMP WITH FLUID END

(71) Applicant: GD Energy Products, LLC, Tulsa, OK (US)

(72) Inventors: Konner Casey Kay, Broken Arrow, OK (US); Adam Bradley Avey, Tulsa, OK (US); Vadim Kachkovskiy, Spring Mills, PA (US); Jacob Gregory Garrison, Tulsa, OK (US)

(73) Assignee: GD ENERGY PRODUCTS, LLC, Tulsa, OK (US)

( * ) Notice: Subject to any disclaimer, the term of this patent is extended or adjusted under 35 U.S.C. 154(b) by 0 days.

(21) Appl. No.: 18/815,982

(22) Filed: Aug. 27, 2024

(65) Prior Publication Data

US 2024/0418165 A1 Dec. 19, 2024

Related U.S. Application Data

(63) Continuation-in-part of application No. 17/958,633, filed on Oct. 3, 2022, now Pat. No. 12,092,102.

(51) Int. Cl.

| | |
|---|---|
| ***F04B 53/16*** | (2006.01) |
| ***F04B 53/14*** | (2006.01) |
| ***F04B 53/22*** | (2006.01) |

(52) U.S. Cl.

CPC ..... *F04B 53/16* (2013.01); *F04B 53/14* (2013.01); *F04B 53/22* (2013.01)

(58) Field of Classification Search

CPC ..... F04B 53/14; F04B 53/16; F04B 53/162; F04B 53/164; F04B 53/22

See application file for complete search history.

(56) References Cited

U.S. PATENT DOCUMENTS

| | | | |
|---|---|---|---|
| 4,878,815 | A | 11/1989 | Stachowiak |
| 5,253,987 | A | 10/1993 | Harrison |
| 6,419,459 | B1 | 7/2002 | Sibbing |
| 8,528,462 | B2 | 9/2013 | Pacht |
| 9,188,123 | B2 | 11/2015 | Hubenschmidt et al. |
| 9,284,953 | B2 | 3/2016 | Blume |
| 9,976,544 | B2 | 5/2018 | Morreale |
| 10,184,470 | B2 | 1/2019 | Barnett, Jr. |
| 10,247,184 | B2 | 4/2019 | Chunn et al. |
| 10,288,178 | B2 | 5/2019 | Nowell et al. |

(Continued)

FOREIGN PATENT DOCUMENTS

| | | | |
|---|---|---|---|
| WO | 2020123431 | A1 | 6/2020 |
| WO | 2021195572 | A1 | 9/2021 |
| WO | 2021211767 | A1 | 10/2021 |

OTHER PUBLICATIONS

Extended European Search Report for European Patent Application No. 23201038.9 dated Mar. 4, 2024, 7 pages.

*Primary Examiner* — Loren C Edwards

(74) *Attorney, Agent, or Firm* — Edell, Shapiro & Finnan, LLC

(57) ABSTRACT

A fluid end includes a housing having a bore configured to receive a closure element, the bore extending through the housing along an axis and including a wall comprising first threads and a retainer configured to be positioned in the bore of the housing. The retainer includes second threads configured to engage with the first threads of the wall of the housing, and a lateral surface area of the wall of the housing and/or of the retainer is greater than 531 square centimeters.

20 Claims, 9 Drawing Sheets

(56) References Cited

U.S. PATENT DOCUMENTS

| | | | |
|---|---|---|---|
| 10,591,070 | B2 | 3/2020 | Nowell et al. |
| 10,648,490 | B2 | 5/2020 | Foster et al. |
| 10,670,013 | B2 | 6/2020 | Foster et al. |
| 10,724,635 | B1 | 7/2020 | Chady |
| 10,760,567 | B2 | 9/2020 | Salih et al. |
| 10,781,803 | B2 | 9/2020 | Kumar et al. |
| 10,895,325 | B2 | 1/2021 | Nowell et al. |
| 10,907,738 | B2 | 2/2021 | Nowell et al. |
| 10,941,765 | B2 | 3/2021 | Nowell et al. |
| 10,941,866 | B2 | 3/2021 | Nowell et al. |
| 10,962,001 | B2 | 3/2021 | Nowell et al. |
| 10,989,188 | B2 | 4/2021 | Surjaatmadja et al. |
| D928,917 | S | 8/2021 | Nowell et al. |
| 11,078,903 | B2 | 8/2021 | Nowell et al. |
| 11,105,322 | B2 | 8/2021 | Marica |
| 11,131,295 | B2 | 9/2021 | Mullins et al. |
| 11,143,315 | B2 | 10/2021 | Nowell et al. |
| 11,162,479 | B2 | 11/2021 | Thomas et al. |
| 11,168,676 | B2 | 11/2021 | Lesko |
| 11,208,996 | B2 | 12/2021 | Foster et al. |
| 11,208,997 | B2 | 12/2021 | Chady et al. |
| 11,268,507 | B2 | 3/2022 | Chady et al. |
| 11,293,432 | B2 | 4/2022 | Cordes et al. |
| 11,300,111 | B2 | 4/2022 | Thomas et al. |
| 11,346,339 | B2 | 5/2022 | Nowell et al. |
| 11,359,615 | B2 | 6/2022 | Thomas et al. |
| 11,391,374 | B1 | 7/2022 | Ellisor et al. |
| 11,421,679 | B1 | 8/2022 | Mullins et al. |
| 11,434,901 | B2 | 9/2022 | Nowell et al. |
| 11,454,321 | B2 | 9/2022 | Mullins et al. |
| 11,708,830 | B2 | 7/2023 | Nowell |
| 2011/0189040 | A1* | 8/2011 | Vicars ..... F04B 53/00 417/559 |
| 2017/0146011 | A1* | 5/2017 | Hiller ..... F04B 53/14 |
| 2017/0211565 | A1 | 7/2017 | Morreale |
| 2018/0266573 | A1 | 9/2018 | Nowell et al. |
| 2019/0120389 | A1 | 4/2019 | Foster et al. |
| 2019/0178243 | A1 | 6/2019 | Nowell et al. |
| 2019/0226589 | A1 | 7/2019 | Nowell et al. |
| 2019/0360483 | A1 | 11/2019 | Nowell et al. |
| 2019/0368619 | A1 | 12/2019 | Barnett et al. |
| 2020/0182240 | A1* | 6/2020 | Nowell ..... F16J 15/184 |
| 2020/0232450 | A9 | 7/2020 | Nowell et al. |
| 2020/0284253 | A1 | 9/2020 | Foster et al. |
| 2020/0362853 | A1* | 11/2020 | Hurst ..... F04B 53/102 |
| 2020/0386221 | A1 | 12/2020 | Pham et al. |
| 2021/0095650 | A1 | 4/2021 | Nowell et al. |
| 2021/0102630 | A1 | 4/2021 | Nowell et al. |
| 2021/0108734 | A1 | 4/2021 | Nowell et al. |
| 2021/0190067 | A1 | 6/2021 | Nowell et al. |
| 2021/0215154 | A1 | 7/2021 | Nowell et al. |
| 2021/0270263 | A1 | 9/2021 | Stephens et al. |
| 2021/0340978 | A1 | 11/2021 | Graham et al. |
| 2021/0341079 | A1 | 11/2021 | Thomas et al. |
| 2021/0348690 | A1 | 11/2021 | Nowell et al. |
| 2021/0404464 | A1 | 12/2021 | Patoskie |
| 2021/0404561 | A1 | 12/2021 | Nowell et al. |
| 2022/0018385 | A1 | 1/2022 | Marica |
| 2022/0099073 | A1 | 3/2022 | Thomas et al. |
| 2022/0106951 | A1 | 4/2022 | Foster et al. |
| 2022/0163033 | A1 | 5/2022 | Myers et al. |
| 2022/0163034 | A1 | 5/2022 | Foster et al. |
| 2022/0170580 | A1 | 6/2022 | Stratulate et al. |
| 2022/0186718 | A1 | 6/2022 | Peer |
| 2022/0195853 | A1 | 6/2022 | Nowell et al. |
| 2022/0282719 | A1 | 9/2022 | Barnhouse |

* cited by examiner

400

| | 1 (402) | 2 (404) | 3 (406) | PRIOR ART 1 (408) | PRIOR ART 2 (410) |
|---|---|---|---|---|---|
| RECIP DIAMETER (412) | 4.00 | 4.50 | 5.00 | 4.00 | 4.50 |
| HOLE OFFSET / THREADED WALL LENGTH (414) | 3.20 | 3.20 | 3.20 | 3.55 | 3.55 |
| BORE OFFSET / THREADED WALL LENGTH (416) | 2.67 | 2.67 | 2.67 | 2.96 | 2.96 |
| (THREAD SIZE / RECIP DIAMETER) + THREADED WALL LENGTH (418) | 5.69 | 5.47 | 5.3 | 5.07 | 5.10 |
| LATERAL SURFACE AREA (420) | 91.25 | 91.25 | 91.25 | 71.64 | 82.25 |

FIG.4

450

| | 1 (402) | 2 (404) | 3 (406) | PRIOR ART 1 (408) | PRIOR ART 2 (410) |
|---|---|---|---|---|---|
| RECIP DIAMETER (412) | 10.16 | 11.43 | 12.70 | 10.16 | 11.43 |
| HOLE OFFSET / THREADED WALL LENGTH (414) | 3.20 | 3.20 | 3.20 | 3.55 | 3.55 |
| BORE OFFSET / THREADED WALL LENGTH (416) | 2.67 | 2.67 | 2.67 | 2.96 | 2.96 |
| (THREAD SIZE / RECIP DIAMETER) + THREADED WALL LENGTH (418) | 11.46 | 11.25 | 11.08 | 10.27 | 10.31 |
| LATERAL SURFACE AREA (420) | 588.71 | 588.71 | 588.71 | 462.19 | 530.64 |

FIG.5

600

| | 1 (602) | 2 (604) | PRIOR ART 1 (606) | PRIOR ART 2 (608) |
|---|---|---|---|---|
| THREADED LENGTH / UNTHREADED LENGTH (612) | 1.71 | 1.71 | N/A | N/A |
| THREADED DIAMETER / UNTHREADED DIAMETER (614) | 1.17 | 1.14 | N/A | N/A |
| CENTER OF GRAVITY TO THREADED END (616) | 0.56 | 0.59 | 1.29 | 1.32 |
| EXTERIOR SURFACE TO CENTER OF GRAVITY / INTERIOR SURFACE TO CENTER OF GRAVITY (618) | 0.95 | 0.97 | 0.75 | 0.79 |
| LATERAL SURFACE AREA (620) | 94.80 | 109.81 | 63.21 | 72.72 |

FIG.8

650

| | 1 (602) | 2 (604) | PRIOR ART 1 (606) | PRIOR ART 2 (608) |
|---|---|---|---|---|
| THREADED LENGTH / UNTHREADED LENGTH (612) | 1.71 | 1.71 | N/A | N/A |
| THREADED DIAMETER / UNTHREADED DIAMETER (614) | 1.17 | 1.14 | N/A | N/A |
| CENTER OF GRAVITY TO THREADED END (616) | 1.42 | 1.50 | 3.28 | 3.35 |
| EXTERIOR SURFACE TO CENTER OF GRAVITY / INTERIOR SURFACE TO CENTER OF GRAVITY (618) | 0.95 | 0.97 | 0.75 | 0.79 |
| LATERAL SURFACE AREA (620) | 611.61 | 708.45 | 407.81 | 469.16 |

FIG.9

RECIPROCATING PUMP WITH FLUID END

CROSS-RELATED

The patent application is a continuation-in-part of U.S. patent application Ser. No. 17/958,633, entitled "POWER END MOUNT PLATE," filed Oct. 3, 2022, which is hereby incorporated in its entirety for all purposes.

TECHNICAL FIELD

The present disclosure relates to the field of high pressure reciprocating pumps and, in particular, to a reciprocating pump with components having particular dimensions.

BACKGROUND

High pressure reciprocating pumps are often used to deliver high pressure fluids during earth drilling operations. Generally, a reciprocating pump includes a power end and a fluid end. The power end can generate forces sufficient to cause the fluid end to deliver high pressure fluids to earth drilling operations. For example, the power end includes a crankshaft that drives a plurality of reciprocating elements near or within the fluid end to pump fluid at high pressure. The fluid end receives the fluid and directs the fluid as a result of movement of the plurality of reciprocating elements. The fluid end includes at least one retainer to help seal at least one bore of the fluid end and block fluid flow out of the fluid end via the at least one bore. Thus, it is desirable to stably and firmly secure the retainer to the fluid end, while still allowing the retainer to be removed, to enable the fluid end to pressurize and direct fluid flow.

SUMMARY

The present application relates to a fluid end of a reciprocating pump. The techniques discussed herein may be embodied as at least a fluid end and a retainer of a fluid end.

More specifically, in accordance with at least one embodiment, the present application is directed to a fluid end. The fluid end includes a housing having a bore configured to receive a closure element, the bore extending through the housing along an axis and including a wall comprising first threads. The fluid end also includes a retainer configured to be positioned in the bore of the housing. The retainer includes second threads configured to engage with the first threads of the wall of the housing, and a lateral surface area of the wall of the housing and/or of the retainer is greater than 531 square centimeters.

In accordance with another embodiment, the present application is directed to a retainer of a fluid end. The retainer includes a threaded portion configured to engage with threads of a wall of the fluid end. The wall defines a bore in which the retainer is configured to be inserted, and the threaded portion extends from an interior surface to a shoulder of the retainer, the interior surface being configured to lead insertion of the retainer into the bore. The retainer also includes an unthreaded portion extending from the shoulder to an exterior surface, opposite the interior surface, to establish a center of gravity of the retainer that is more adjacent to the exterior surface than to the interior surface.

In accordance with yet another embodiment, the present application is directed to a fluid end of a reciprocating pump. The fluid end includes a housing having a bore extending along an axis from a pumping chamber of the housing to an external surface of the housing. The bore includes a wall with threads configured to engage a retainer installed in the bore, the wall having a first diameter and extends a length along the axis. The fluid end also includes a reciprocating element with a second diameter. The length of the wall in centimeters plus a ratio of the first diameter of the wall in centimeters relative to the second diameter of the reciprocating element in centimeters is greater than 10.4.

The foregoing advantages and features will become evident in view of the drawings and detailed description.

BRIEF DESCRIPTION OF THE DRAWINGS

To complete the description and in order to provide for a better understanding of the present application, a set of drawings is provided. The drawings form an integral part of the description and illustrate embodiments of the present application, which should not be interpreted as restricting the scope of the disclosure, but just as examples. The drawings comprise the following figures:

FIG. 4 is a table illustrating dimensions of various reciprocating pumps as measured using inches, in accordance with embodiments of the present disclosure.

FIG. 5 is the table of FIG. 4 with dimensions as measured using centimeters.

FIG. 8 is a table illustrating dimensions of various retainers for a reciprocating pump as measured using inches, in accordance with embodiments of the present disclosure.

FIG. 9 is the table of FIG. 8 with dimensions as measured using centimeters.

Like reference numerals have been used to identify like elements throughout this disclosure.

DETAILED DESCRIPTION

Figure 1:
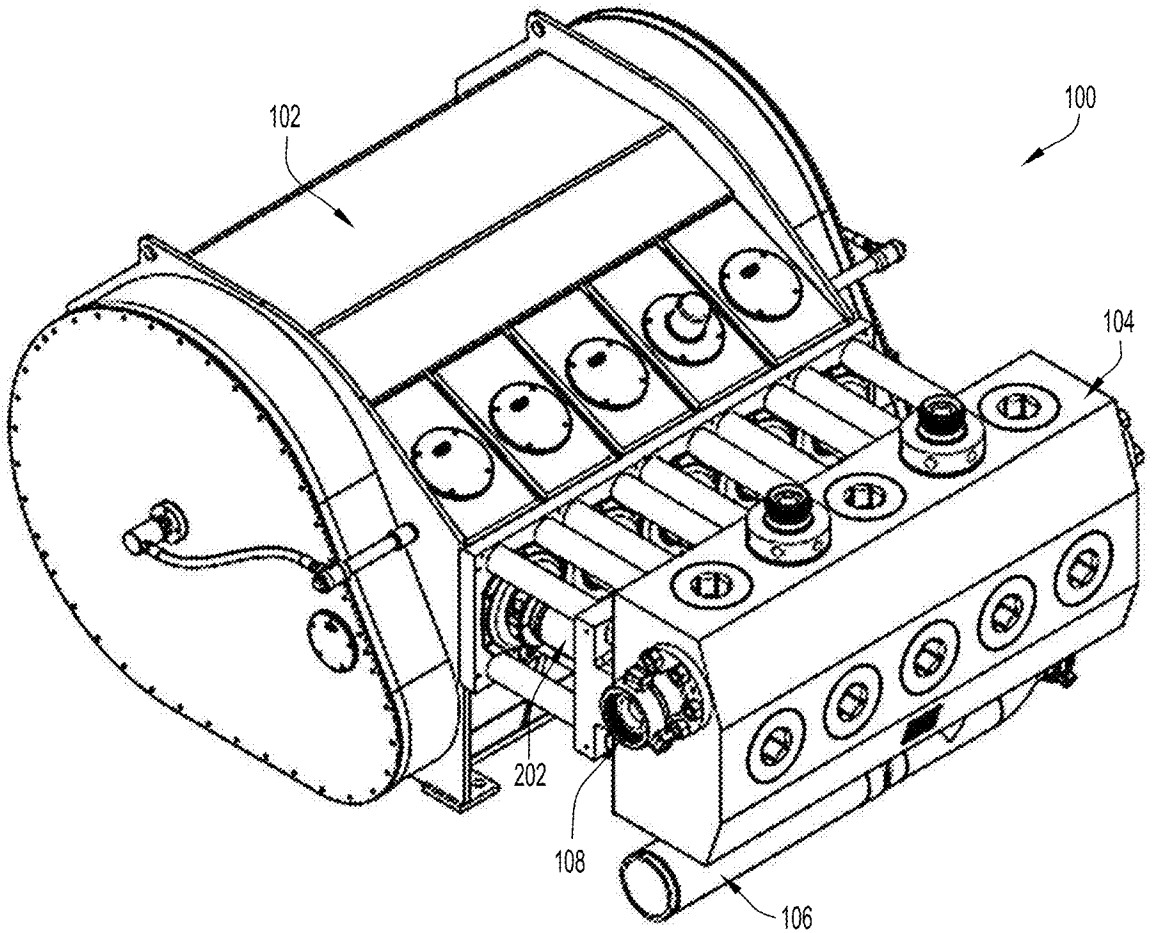
FIG. 1 is a front perspective view of a reciprocating pump including a fluid end and a power end, in accordance with embodiments of the present disclosure.

The following description is not to be taken in a limiting sense but is given solely for the purpose of describing the broad principles of the disclosure. Embodiments of the disclosure will be described by way of example, with reference to the above-mentioned drawings showing elements and results according to the present disclosure.

Generally, the present application is directed to a fluid end of a reciprocating pump. The fluid end includes a casing in which a reciprocating element is configured to move to pressurize fluid within a pumping chamber defined by the casing. For example, a first bore segment formed through the casing directs fluid into the pumping chamber, and movement (e.g., a discharge stroke) of the reciprocating element pressurizes the fluid and directs fluid out of the pumping chamber via a second bore segment. The fluid end includes valves that operate to direct fluid desirably from the first bore segment to the second bore segment (e.g., to prevent or at least discourage backflow out of the fluid end via the first bore segment).

The fluid end also includes a third bore segment extending from an exterior surface of the casing to the pumping chamber. In some embodiments, the third bore segment provides access to the pumping chamber, such as for performing a maintenance operation with respect to a component (e.g., a valve) within the pumping chamber. During operation of the fluid end, the third bore segment is closed to block fluid flow therethrough, thereby forcing fluid flow from the first bore segment to the second bore segment. To this end, a closure element is inserted into the third bore segment, and a retainer is secured within the third bore segment to maintain a position of the closure element within the third bore segment. However, during operation of the fluid end, a substantial amount of force/pressure is imparted onto the closure element and the retainer, such as via movement of the reciprocating element.

Embodiments of the present disclosure are directed to increasing securement of the retainer within the third bore segment, such as to withstand the force/pressure imparted onto the retainer, to maintain closure of the third bore segment. For example, in certain implementations, the wall surrounding the third bore segment includes a sufficient lateral surface area that may be defined at least partially by a length and/or a diameter of the wall. As used herein, a "lateral surface area" of the wall refers to an approximate surface area of the wall that encompasses threads, rather than a total surface area of the threads provided by cumulatively adding the respective surface area of each individual thread. That is, the lateral surface area of the wall is calculated by a linear distance extending across each thread, in contrast to the individual distances traversing up and down each thread. The lateral surface area indicates an amount of surface area of the wall that can threadedly engage with the retainer. Thus, a sufficient lateral surface area provides sufficient threaded engagement between the retainer and the wall to secure the wall within the third bore segment. Additionally or alternatively, the retainer includes a threaded portion configured to engage with threads of the wall and an unthreaded portion that extends from the threaded portion and does not include threads. The presence of the unthreaded portion establishes a particularly positioned center of gravity, along with additional weight and rigidity, of the retainer to increase the capability of the retainer to withstand movement that could otherwise be caused by the force/pressure imparted by the reciprocating element. For instance, the threaded portion and the unthreaded portion may provide a sufficient lateral surface area (i.e., an approximate surface area that encompasses the threaded portion and the unthreaded portion) of the retainer that stabilizes the retainer, thereby securing the retainer within the third bore segment. As such, the wall and/or the retainer has a sufficient lateral surface area to secure the retainer within the third bore segment to help close the third bore segment during operation of the fluid end.

Referring to FIG. 1, a reciprocating pump 100 is illustrated. The reciprocating pump 100 includes a power end 102 and a fluid end 104. The power end 102 includes a crankshaft that drives a plurality of reciprocating plungers or pistons (generally referred to as "reciprocating elements") enclosed within the fluid end 104 to pump fluid at high pressure (e.g., to cause the fluid end 104 to deliver high pressure fluids to earth drilling operations). For example, the power end 102 may be configured to support hydraulic fracturing (i.e., fracking) operations, where fracking liquid (e.g., a mixture of water, chemicals, and/or sand) is injected into rock formations at high pressures to allow natural oil and gas to be extracted from the rock formations. However, to be clear, this example is not intended to be limiting, and the present application may be applicable to both fracking and drilling operations, as well as any other suitable operations.

In any case, often, the reciprocating pump 100 may be quite large and may, for example, be supported by a semi-tractor truck ("semi") that can move the reciprocating pump 100 to and from a well. Specifically, in some instances, a semi may move the reciprocating pump 100 off a well to perform maintenance on the reciprocating pump 100. However, a reciprocating pump 100 is typically moved off a well only when a replacement pump (and an associated semi) is available to move into place at the well, which may be rare. Thus, often, the reciprocating pump 100 is taken offline at a well and maintenance is performed while the reciprocating pump 100 remains on the well. If not for this maintenance, the reciprocating pump 100 could operate continuously to extract natural oil and gas (or conduct any other operation). Consequently, any improvements that extend the lifespan of components of the reciprocating pump 100, extend the time between maintenance operations (i.e., between downtime), and/or minimize the time to complete maintenance operations (minimizing downtime) are highly desirable.

Figure 2:
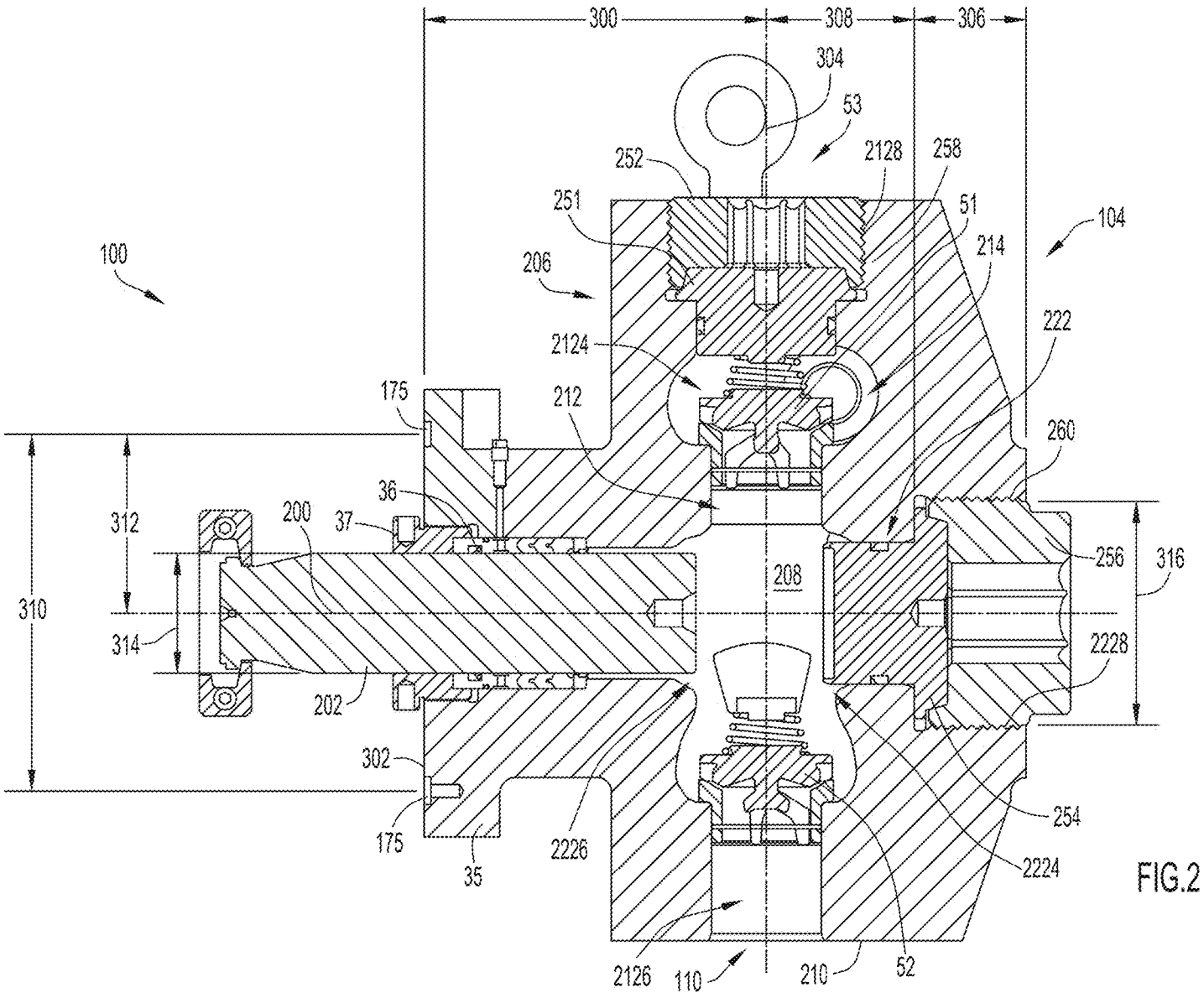
FIG. 2 is a side cross-sectional view of the reciprocating pump of FIG. 1.

FIG. 2 is a side cross-sectional view of the fluid end 104 of the reciprocating pump 100 taken along a central or plunger axis 200 (e.g., a longitudinal axis) of a reciprocating element 202 (e.g., a plunger) included in the reciprocating pump 100. Thus, although FIG. 2 depicts a single pumping chamber 208, it should be understood that a fluid end 104 can include multiple pumping chambers 208 arranged side-by-side. In fact, in at least some embodiments (e.g., the embodiment of FIG. 1), a casing or housing 206 of the fluid end 104 forms a plurality of pumping chambers 208, and each chamber 208 includes a respective reciprocating element 202 that reciprocates within the casing 206. However, side-by-side pumping chambers 208 need not be defined by a single casing 206. For example, in some embodiments, the fluid end 104 may be modular, and different casing segments may house one or more pumping chambers 208. In any case, the one or more pumping chambers 208 are arranged side-by-side so that corresponding conduits are positioned adjacent each other and generate substantially parallel pumping action. Specifically, with each stroke of the reciprocating element 202, low pressure fluid is drawn into the pumping chamber 208 and high pressure fluid is discharged from the pumping chamber 208. For case of description, FIGS. 1 and 2 will be discussed in combination with one another.

As can be seen in FIG. 2, the pumping paths and pumping chamber 208 of the fluid end 104 are formed by bores/conduits that extend through the casing 206 to define openings at an external surface 210 of the casing 206. More specifically, a first bore 212 extends longitudinally (e.g., vertically) through the casing 206 while a second bore 222 extends laterally (e.g., horizontally) through the casing 206. Thus, the first bore 212 intersects the second bore 222 to at least partially (and collectively) define the pumping chamber 208. The bores 212, 222 may be substantially cylindrical and/or include varying diameters throughout the casing 206 to receive various structure, such as sealing assemblies or components thereof.

Regardless of the diameters of the first bore 212 and the second bore 222, each bore 212, 222 may include two segments, each of which extends from the pumping chamber 208 to the external surface 210 of the casing 206. Specifically, the first bore 212 includes a first segment 2124 and a second segment 2126 that opposes the first segment 2124. Likewise, the second bore 222 includes a third segment 2224 and a fourth segment 2226 that opposes the third segment 2224. In the depicted embodiment, the segments of a bore (e.g., segments 2124, 2126 and/or segments 2224, 2226) are substantially coaxial, while the segments of different bores are substantially orthogonal. However, in other embodiments, the segments 2124, 2126, 2224, 2226 may be arranged along any desired angle or angles, for example, to intersect pumping chamber 208 at one or more non-straight angles.

In the depicted embodiment, the first bore 212 defines a fluid path through the fluid end 104. The second segment 2126 is an intake segment that connects the pumping chamber 208 to a piping system 106 delivering fluid to the fluid end 104. Meanwhile, the first segment 2124 is an outlet or discharge segment that allows compressed fluid to exit the fluid end 104. Thus, the segments 2126, 2124 include valve components 51, 52 (e.g., one-way valves), respectively, that allow the segments 2126, 2124 to selectively open. The valve components 51 in the first segment 2124 may be secured therein by a closure assembly 53 that includes a closure element 251 (e.g., a discharge plug) that is secured in the first segment 2124 by a retainer 252. Meanwhile, the valve components 52 in the second segment 2126 may be secured therein by the piping system 106. Notably, the retainer 252 is coupled to the first segment 2124 via threads 2128 defined by an interior wall 258 (e.g., a lateral wall) surrounding the first segment 2124.

Overall, in operation, fluid may enter the fluid end 104 via multiple openings 110 and exit the fluid end 104 via multiple openings 214. In at least some embodiments, fluid enters the openings 214 via pipes of the piping system 106, flows through the pumping chamber 208 (due to reciprocation of the reciprocating element 202), and then flows through the openings 214 into a channel 108. However, the piping system 106 and channel 108 are merely example conduits and, in various embodiments, the fluid end 104 may receive and discharge fluid via any number of pipes and/or conduits, along pathways of any desirable size or shape.

On the other hand, the fourth segment 2226 defines, at least in part, a cylinder for the reciprocating element 202 and/or connects the casing 206 to a cylinder for the reciprocating element 202. For example, in the depicted embodiment, the casing 206 includes a nose flange 35 that houses a packing assembly 36 configured to seal against the reciprocating element 202 disposed interiorly of the packing assembly 36. In any case, reciprocation of the reciprocating element 202 in or adjacent to the fourth segment 2226, which may be referred to as a reciprocation segment, draws fluid into the pumping chamber 208 via the second segment 2126 and pumps the fluid out of the pumping chamber 208 via the first segment 2124. In this embodiment, the packing assembly 36 is retained within the nose flange 35 with a retaining element 37 that is threadedly coupled to the nose flange 35.

The third segment 2224 is an access segment that can be opened to access parts disposed within the casing 206 and/or surfaces defined within the casing 206, such as for performing maintenance operations. During operation, the third segment 2224 may be closed by a closure assembly that includes a closure element 254 (e.g., a suction plug) that is secured in the third segment 2224 by a retainer 256. Notably, the retainer 256 is coupled to the third segment 2224 via threads 2228 defined by an interior wall 260 (e.g., a lateral wall) surrounding the third segment 2224.

To operate properly, the fluid end 104 is to be securely and stably coupled to the power end 102. Thus, the fluid end 104 is directly coupled to the power end 102 via couplers (e.g., stay rods) to be extended through the nose flange 35. For this reason, the nose flange 35 includes holes/receptacles 175 configured to receive the couplers (e.g., for a threaded engagement) to position the fluid end 104 in close proximity to the power end 102. The couplers may be removed to provide better access to the fluid end 104, such as to the packing assembly 36. The illustrated fluid end 104 includes holes 175 positioned at opposite sides of the reciprocating element 202 to sufficiently secure the power end 102 to the fluid end 104 via couplers extending through the holes 175.

During operation of the reciprocating pump 100, the second segment 2126 (of the first bore 212) may be an "open" segment that allows fluid to flow from the external surface 210 to the pumping chamber 208. By comparison, the first segment 2124 (of the first bore 212), the third segment 2224 (of the second bore 222), and the fourth segment 2226 (of the second bore 222) may each be "closed" segments to block fluid flow therethrough to the external surface 210. For instance, the reciprocating element 202 blocks fluid flow to the external surface 210 via the fourth segment 2226, the closure element 251 blocks fluid flow to the external surface 210 via the first segment 2124, and the closure element 254 blocks fluid flow to the external surface 210 via the third segment 2224. For this reason, it may be desirable to maintain threaded engagement between the retainers 252, 256 and the respective interior walls 258, 260 to enable the closure elements 251, 254 to block fluid flow to the external surface 210 via the segments 2224, 2226.

In embodiments of the present application, the fluid end 104 includes particular dimensions to help secure the retainers 252, 256 while supporting other fluid end components, minimizing fatigue, and allowing desired pumping. As an example, the fluid end 104 includes a first dimension 300, such as approximately 11.5 inches or 29.21 centimeters, extending from a surface 302 of the nose flange 35 to an axis 304 (e.g., a center axis, a vertical axis) extending through a center of the first segment 2124 and of the second segment 2126 perpendicularly to the central axis 200. The interior wall 260 with which the retainer 256 is engaged also includes a second dimension 306 (e.g., a length) extending along the central axis 200. The fluid end 104 further includes a third dimension 308, such as approximately 5 inches or 12.7 centimeters, extending from the axis 304 to the interior wall 260. Moreover, a fourth dimension 310 extends along the axis 304 between the holes 175 positioned at opposite sides of the reciprocating element 202. Consequently, a fifth dimension 312, which is half of the fourth dimension 310, extends along the axis 304 from the central axis 200 to the holes 175 positioned at one side of the reciprocating element 202. Further still, the reciprocating element 202 includes a sixth dimension 314 (e.g., a diameter, a width, a thickness), and a size (e.g., a width, a diameter) of the threaded engagement between the retainer 256 and the interior wall 260 spans a seventh dimension 316 (e.g., a thread minor diameter). A lateral surface area of the interior wall 260 (i.e., a wall surface area that encompasses threads), which is indicative of an available amount of surface area of the interior wall 260 that can threadedly engage with the retainer 256, is equal to the mathematical product of pi, the second dimension 306, and the seventh dimension 316 (i.e., the mathematical product of the circumference of the interior wall 260 and the second dimension 306).

The dimensions 300, 306, 308, 310, 312, 314, 316 are particularly established to help secure the retainers 252, 256 within the fluid end 104. For instance, the second dimension 306 and/or the seventh dimension 316 may be sufficiently large to enable the threaded engagement between the retainer 256 and the interior wall 260 to withstand a force/pressure imparted by operation of the reciprocating element 202, such as by providing greater threaded shear area for the retainer 256 to distribute stress and limit potential movement (e.g., rotation) of the retainer 256 with respect to the casing 206 while also avoiding concentrating forces onto the retainer 256, thereby increasing a useful lifespan of the retainer 256. As a result, the second dimension 306 and/or the seventh dimension 316 are sized to establish a desirable relationship with respect to the sixth dimension 314 to enable the retainer 256 to remain engaged with the interior wall 260 during operation of the fluid end 104. For example, the second dimension 306 may be at least 3.75 inches or 9.53 centimeters, and the seventh dimension 316 may be at least 7.75 inches or 19.69 centimeters.

Still further, in certain embodiments, the fourth dimension 310 and/or the fifth dimension 312 is established to accommodate a size of the reciprocating element 202. In other words, the fourth dimension 310 and/or the fifth dimension 312 is based on and therefore indicative of the sixth dimension 314 of, as well as a force/pressure imparted by, the reciprocating element 202. As such, the second dimension 306 and/or the seventh dimension 316 may be additionally or alternatively sized to establish a desirable relationship with respect to the fourth dimension 310 and/or the fifth dimension 312 to ensure the second dimension 306 and/or the seventh dimension 316 are sufficiently sized with respect to a size of the reciprocating element 202. By way of example, the fourth dimension 310 may be approximately 12 inches or 30.48 centimeters, and the fifth dimension 312 may be approximately 6 inches or 15.24 centimeters.

Figure 3:
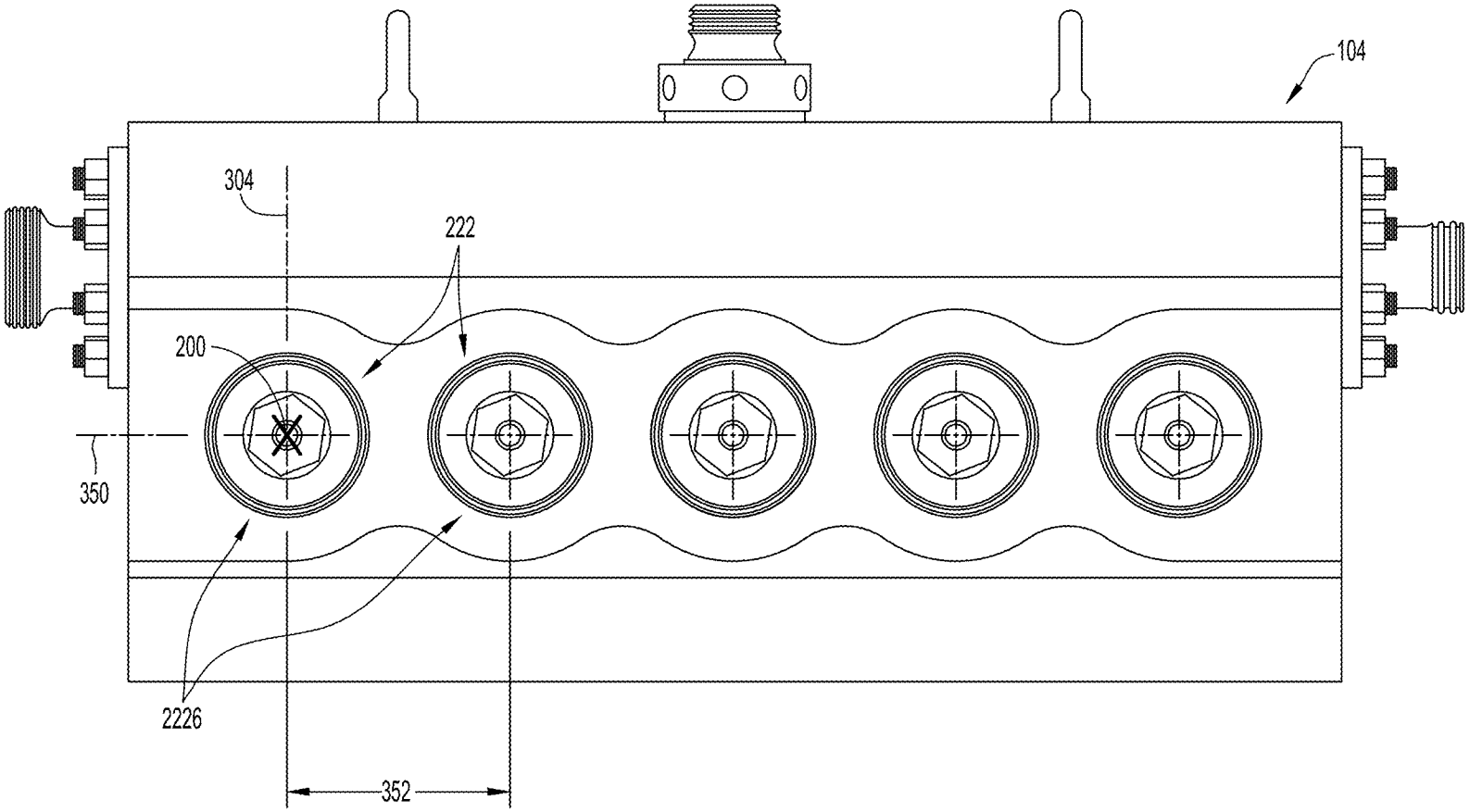
FIG. 3 is a front view of the reciprocating pump of FIG. 1.

As discussed, the fluid end 104 may include multiple reciprocating elements 202. As such, the fluid end fluid end 104 may also include multiple second bores 222 that each include a respective fourth segment 2226 for accommodating positioning of the reciprocating elements 202. FIG. 3 is a front view of the fluid end 104 having multiple second bores 222 and fourth segments 2226 that are offset along an axis 350 (e.g., a lateral axis), which is perpendicular to the central axis 200 and the axis 304. In particular, adjacent second bores 222 are offset by an eighth dimension 352. In some embodiments, the eighth dimension 352 is established to accommodate a size and/or quantity of reciprocating elements 202 implemented in the fluid end 104. Therefore, the eighth dimension 352 is based on and therefore indicative of the sixth dimension 314 of, as well as a force/pressure imparted by, the reciprocating elements 202. Thus, the second dimension 306 and/or the seventh dimension 316 may further be sized to establish a desirable relationship with respect to the eighth dimension 352 to ensure the second dimension 306 and/or the seventh dimension 316 are sufficiently sized with respect to the reciprocating elements 202. As an example, the eight dimension 352 may be approximately 10 inches or 25.4 centimeters.

FIG. 4 is a table 400 illustrating dimensions, as measured using inches, of various reciprocating pumps, including a first reciprocating pump 402, a second reciprocating pump 404, a third reciprocating pump 406, as well as a first prior art reciprocating pump 408 and a second prior art reciprocating pump 410. In particular, the table 400 illustrates: (a) a reciprocating element diameter 412 (e.g., the sixth dimension 314); (b) a first ratio 414 of an offset distance (e.g., the fourth dimension 310) between coupler holes relative to a length (e.g., the second dimension 306) of a threaded wall that engages with a retainer; (c) a second ratio 416 of an offset distance (e.g., the eighth dimension 352) between bores relative to the length (e.g., the second dimension 306) of the threaded wall; (d) a value 418 of the threaded wall length (e.g., the second dimension 306) plus a ratio of a diameter (e.g., the seventh dimension 316) of a threaded portion of a retainer relative to the reciprocating element diameter 412; and (c) a lateral surface area 420 of the threaded wall.

As indicated by the table 400, the first reciprocating pump 402 includes the same reciprocating element diameter 412 as that of the first prior art reciprocating pump 408, and the second reciprocating pump 404 includes the same reciprocating element diameter 412 as that of the second prior art reciprocating pump 410. Meanwhile, the third reciprocating pump 406 includes a larger reciprocating element diameter 412 than each of the other reciprocating pumps 402, 404, 408, 410. However, the value 418 for each of the reciprocating pumps 402, 404, 406 is substantially greater than the value 418 for each of the prior art reciprocating pumps 408, 410. The increased value 418 indicates that the size of the threaded portion of the threaded wall provides a sufficient amount of threaded engagement between the retainer and the threaded wall to withstand a force/pressure imparted by the reciprocating element. For instance, each of the values 418 of the reciprocating pumps 402, 404, 406 may be greater than 5.10, which is the greater of the values 418 of the prior art reciprocating pumps 408, 410.

The lateral surface area 420 also ensures that there is sufficient threaded engagement between the retainer and the threaded wall for the reciprocating pumps 402, 404, 406. Indeed, the lateral surface area 420 of each of the reciprocating pumps 402, 404, 406 is substantially greater than the lateral surface area of the prior art reciprocating pumps 408, 410. For example, the lateral surface area 420 of each of the reciprocating pumps 402, 404, 406 may be greater than 82.25 square inches, which is the greater of the lateral surface areas 420 of the prior art reciprocating pumps 408, 410. To be clear, however, while all of pumps 402, 404, and 406 include a lateral surface area of 91.25 square inches, pumps executing the techniques presented herein need not include a lateral surface area of 91.25 square inches. Instead, pumps of the present application may include any lateral surface area larger than 82.25 square inches.

Additionally or alternatively, the first ratio 414 of each of the reciprocating pumps 402, 404, 406 may be substantially less than the first ratio 414 of each of the prior art reciprocating pumps 408, 410, and/or the second ratio 416 of each of the reciprocating pumps 402, 404, 406 may be substantially less than the second ratio 416 of each of the prior art reciprocating pumps 408, 410. The decreased first ratio 414 and decreased second ratio 416 indicate that the length of the threaded wall is sufficient relative to the reciprocating element diameter 412. In some embodiments, the length of the threaded wall, the offset distance between the coupler holes, the offset distance between the bores, and/or the diameter of the threaded portion of the retainer for the reciprocating pumps 402, 404, 406 are substantially equal across the reciprocating pumps 402, 404, 406. Thus, the first ratio 414 and the second ratio 416 may each be constant across reciprocating pumps 402, 404, 406 (e.g., with the first ratio 414 being 3.20 and the second ratio 416 being 2.67). However, in additional or alternative embodiments, the length of the threaded wall, the offset distance between the coupler holes, the offset distance between the bores, and/or the diameter of the threaded portion of the retainer for the reciprocating pumps 402, 404, 406 are different from one another such that the first ratio 414 and/or the second ratio 416 for each of the reciprocating pumps 402, 404, 406 are different from one another. Nevertheless, the first ratio 414 of each of the reciprocating pumps 402, 404, 406 is less than 3.55, which is the first ratio 414 of each of the prior art reciprocating pumps 408, 410, and the second ratio 416 of each of the reciprocating pumps 402, 404, 406 is less than 2.96, which is the second ratio 416 of each of the prior art reciprocating pumps 408, 410. This is largely driven by the dimensions (e.g., a length) of the threaded wall, which correspondingly directly impacts the securement between the retainer and the fluid end casing.

FIG. 5 is a table 450 illustrating the reciprocating element diameter 412, the first ratio 414, the second ratio 416, the value 418, and the lateral surface area 420, as measured using centimeters, of the first reciprocating pump 402, the second reciprocating pump 404, the third reciprocating pump 406, the first prior art reciprocating pump 408, and the second prior art reciprocating pump 410. As indicated in the table 450, the value 418 of each of the reciprocating pumps 402, 404, 406 is greater than 10.31, which is the greater of the values 418 of the prior art reciprocating pumps 408, 410 to indicate the sufficient threaded engagement between the retainer and the threaded wall. Additionally, the lateral surface area 420 of each of the reciprocating pumps 402, 404, 406 is greater than 530.64 square centimeters, which is the greater of the lateral surface areas 420 of the prior art reciprocating pumps 408, 410, further indicating the sufficient threaded engagement between the retainer and the threaded wall.

Figure 6:
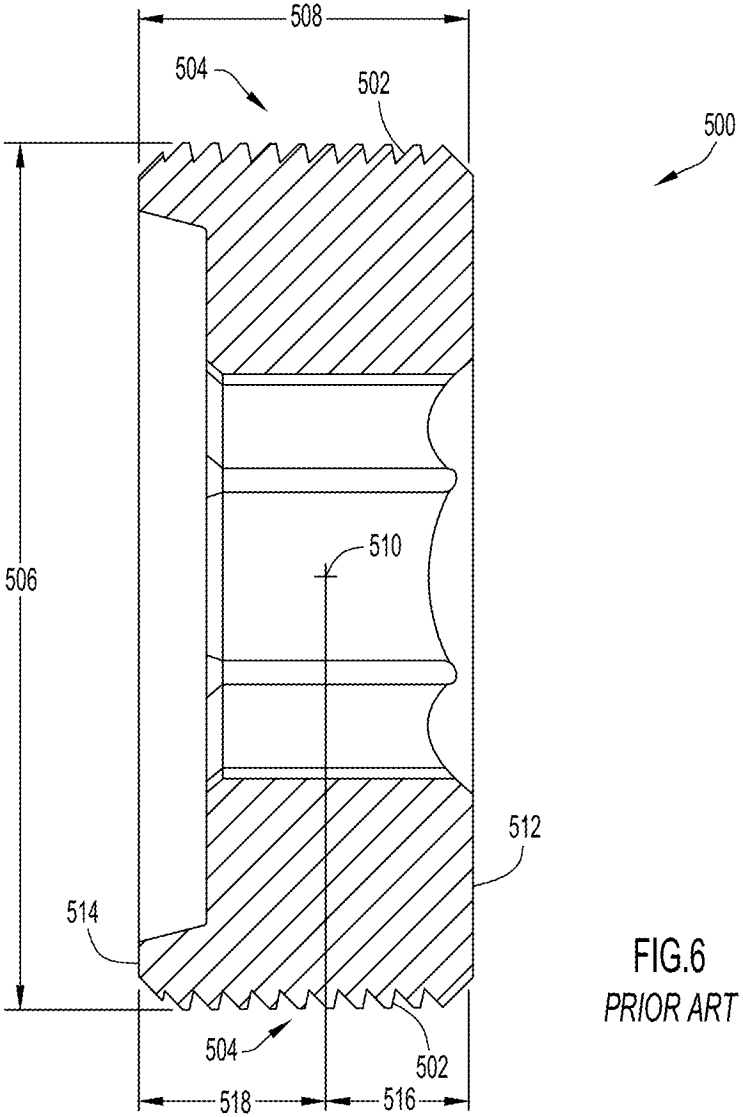
FIG.6 PRIOR ART
FIG. 6 is a side cross-sectional view of a prior art retainer for a reciprocating pump.

FIG. 6 is a side cross-sectional view of a prior art retainer 500 that can be used in any of the reciprocating pumps discussed herein. Indeed, the prior art retainer 500 may be implemented in any of the reciprocating pumps 100, 402, 404, 406 and remain secured to a threaded wall (e.g., the interior wall 258, the interior wall 260) of the reciprocating pumps 100, 402, 404, 406. The prior art retainer 500 includes threads 502 formed along lateral sides 504 of the prior art retainer 500. Moreover, the lateral sides 504 of the prior art retainer 500 span a first dimension 506 (e.g., a thread major diameter) and a second dimension 508 (e.g., a length). Thus, the first dimension 506 and the second dimension 508 (e.g., the cylindrical surface area, as determined by the mathematical product of pi, the first dimension 506, and the second dimension 508) cooperatively define a lateral surface area of the prior art retainer 500 (e.g., a retainer surface area encompassing threads) to indicate an available amount of surface area of the prior art retainer 500 that can threadedly engage with the threaded wall of the reciprocating pump.

The size, shape, and overall arrangement of the prior art retainer 500 also establishes a center of gravity 510 of the prior art retainer 500. The center of gravity 510 is positioned significantly more proximate to a first surface 512 (e.g., an exterior surface that trails insertion of the prior art retainer 500 into a bore segment than to a second surface 514 (e.g., an interior surface that leads insertion of the prior art retainer 500 into a bore segment). To be clear, the first surface 512 faces toward an exterior of the reciprocating pump and away from a pumping chamber while the prior art retainer 500 is secured in the reciprocating pump and the second surface 514 faces toward the pumping chamber and away from an exterior of the reciprocating pump while the prior art retainer 500 is secured in the reciprocating pump. Accordingly, a first distance 516 between the center of gravity 510 and the first surface 512 is substantially smaller than a second distance 518 between the center of gravity 510 and the second surface 514. Positioning the center of gravity 510 substantially closer to the first surface 512 than to the second surface 514 may reduce securement of the prior art retainer 500 within the reciprocating pump. For example, such a position of the center of gravity 510 farther away from the second surface 514 may reduce the capability of the second surface 514 to withstand movement (e.g., rotation) relative to the threaded wall in response to a force/pressure imparted by the reciprocating element.

Figure 7:
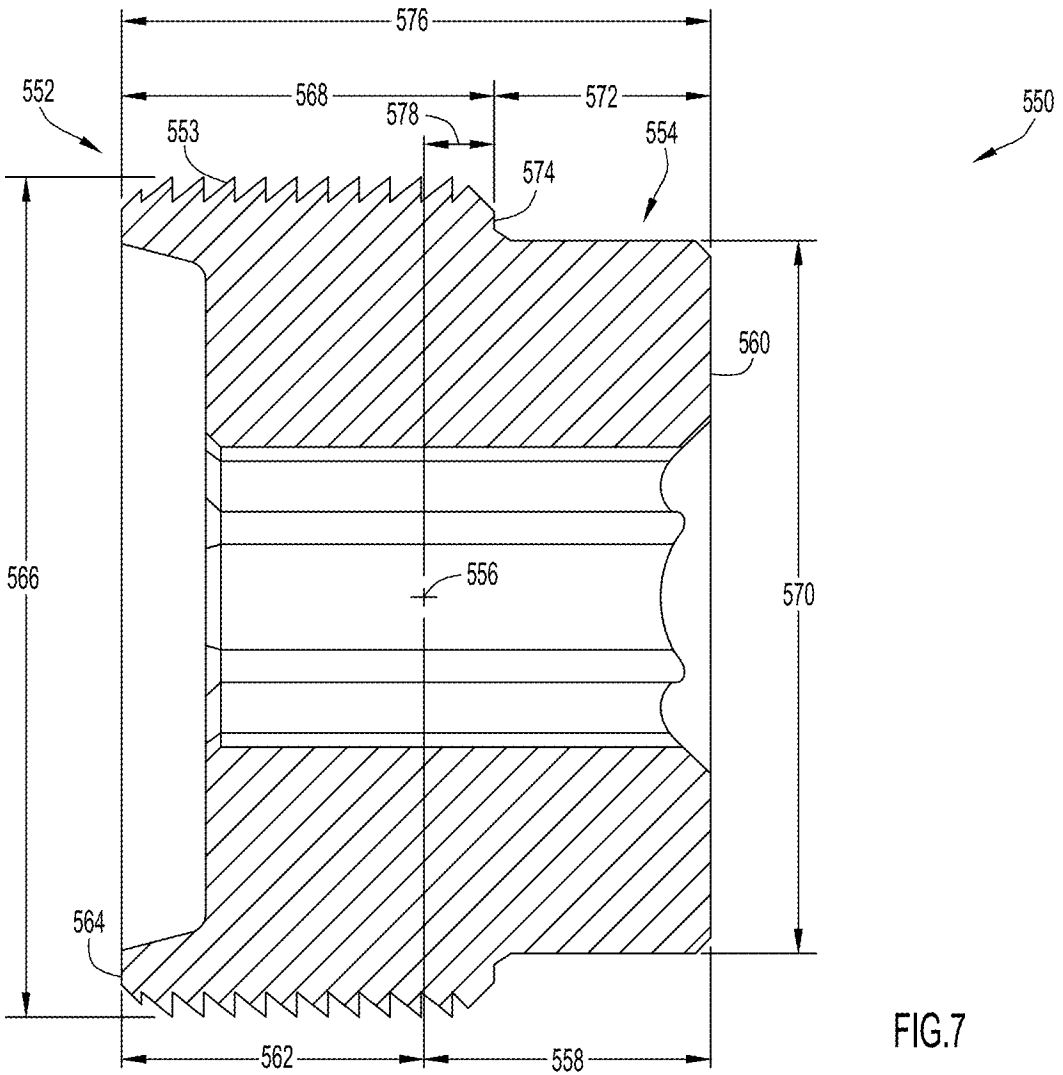
FIG. 7 is a side cross-sectional view of a retainer for a reciprocating pump, in accordance with embodiments of the present disclosure.

FIG. 7 is a side cross-sectional view of a retainer 550 that can be used in any of the reciprocating pumps discussed herein. In certain embodiments, the retainer 550 can be used in a reciprocating pump that does not include a threaded wall with a substantial lateral surface area (e.g., a lateral surface area at or below 82.25 square inches or 530.64 square centimeters). Nevertheless, the retainer 550 includes features that facilitate securement in the reciprocating pump.

In particular, the retainer 550 includes a threaded portion 552 (e.g., a base portion), which has threads 553 configured to engage with corresponding threads of a threaded wall (e.g., the interior walls 258, 260), and an unthreaded portion 554 (e.g., a nose portion), which lacks any threads. The presence of the unthreaded portion 554 causes a center of gravity 556 of the retainer 550 to be positioned in a position that increases securement of the retainer 550 in a reciprocating pump and/or that decreases the probability of the securement unwantedly decoupling. As an example, a first distance 558 between the center of gravity 556 and a first surface 560 (e.g., an exterior surface that trails insertion of the retainer 550 into a bore) of the unthreaded portion 554 may be similar to (e.g., within 10% of, within 5% of) a second distance 562 between the center of gravity 556 and a second surface 564 (e.g., an interior surface that leads insertion of the retainer 550 into a bore) of the threaded portion 552. To be clear, the first surface 560 faces toward an exterior of the reciprocating pump and away from a pumping chamber while the second surface 564 faces toward the pumping chamber and away from the exterior of the reciprocating pump. As a specific example, the first distance 558 may be approximately 2.3 inches or 5.84 centimeters, and the second distance 562 may be approximately 2.4 inches or 6.10 centimeters. The positioning of the center of gravity 556 substantially equidistant to the first surface 560 and to the second surface 564 increases the rigidity of the retainer to enable the retainer 550 to withstand movement (e.g., rotation) relative to the threaded wall in response to a force/pressure imparted by the reciprocating element, thereby providing the retainer 550 with sufficient stability to remain secured in the reciprocating pump. That is, the center of gravity 556 ensures that the retainer 550 is sufficiently secured within a fluid end.

In certain embodiments, the threaded portion 552 has a similar shape/size as that of the prior art retainer 500. For example, the threaded portion 552 may include a first dimension 566 (e.g., a thread major diameter) that is similar to the first dimension 506 of the prior art retainer 500 and a second dimension 568 (e.g., a length) that is similar to the second dimension 508 of the prior art retainer 500. As such, a lateral surface area of the threaded portion 552 may be similar to the lateral surface area of the prior art retainer 500. By way of example, the first dimension 566 may be approximately 6.71 inches or 17.04 centimeters in some embodiments or approximately 7.72 inches or 19.61 centimeters in other embodiments, whereas the second dimension 568 may be approximately 3 inches or 7.62 centimeters.

The unthreaded portion 554, however, extends from the threaded portion 552, thereby increasing the overall lateral surface area of the retainer 550 (i.e., the retainer surface area encompassing the threaded portion 552 and the unthreaded portion 554) to be greater than the lateral surface area of the prior art retainer 500. The unthreaded portion 554 includes a third dimension 570 (e.g., a diameter) and a fourth dimension 572 (e.g., a length). The third dimension 570 of the illustrated unthreaded portion 554 is less than the first dimension 566 of the threaded portion 552. For instance, the third dimension 570 may be approximately 6.75 inches or 17.15 centimeters or approximately 5.75 inches or 14.61 centimeters, whereas the fourth dimension 572 may be approximately 1.75 inches or 4.45 centimeters. The difference in the first dimension 566 and the third dimension 570 forms a shoulder 574 that transitions from the threaded portion 552 to the unthreaded portion 554. That is, the threaded portion 552 terminates at the shoulder 574, and the unthreaded portion 554 extends from the shoulder 574. A fifth dimension 576 (e.g., an overall length) of the retainer 550 is defined by the second dimension 568 plus the fourth dimension 572, and a third distance 578 extends from the center of gravity 556 to the shoulder 574.

The overall lateral surface area of the retainer 550 is equal to the lateral surface area of the threaded portion 552 plus the lateral surface area of the unthreaded portion 554. That is, the overall lateral surface area of the retainer 550 is equal to the mathematical product of pi, the first dimension 566, and the second dimension 568 (i.e., the cylindrical surface area, as determined by the mathematical product of the circumference of the threaded portion 552 and the second dimension 568) plus the mathematical product of pi, the third dimension 570, and the fourth dimension 572 (i.e., the cylindrical surface area, as determined by the mathematical product of the circumference of the unthreaded portion 554 and the fourth dimension 572). The increased lateral surface area of the retainer 550 relative to the lateral surface area of the prior art retainer 500 helps block movement (e.g., rotation) of the retainer 550 with respect to the threaded wall by providing a more desirable placement of the center of gravity 556. Indeed, even though the unthreaded portion 554 does not threadedly engage with the threaded wall (e.g., such that the retainer 550 includes a similar amount of surface area as that of the prior art retainer 500 for threadedly engaging the threaded wall), the presence of the unthreaded portion 554 increases securement of the retainer 550 in the reciprocating pump.

FIG. 8 is a table 600 illustrating dimensions, as measured using inches, of various retainers, including a first retainer 602, a second retainer 604, a first prior art retainer 606, and a second prior art retainer 608. In particular, the table 600 illustrates: (a) a first ratio 612 of a length of a threaded portion (e.g., the second dimension 568) relative to a length of an unthreaded portion (e.g., the fourth dimension 572); (b) a second ratio 614 of a diameter of a threaded portion (e.g., the first dimension 566) relative to a diameter of an unthreaded portion (e.g., the third dimension 570); (c) a first distance 616 (e.g., the first distance 516, the third distance 578) from a center of gravity to a downstream end of the threads (e.g., the first surface 512, the shoulder 574); (d) a third ratio 618 of a distance (e.g., the first distance 516, the first distance 558) from the center of gravity to an exterior surface relative to a distance (e.g., the second distance 518, second distance 562) from the center of gravity to an interior surface (e.g., the second surface 514, the second surface 564); and (c) an overall lateral surface area 620.

Each of the retainers 602, 604 includes a first ratio 612 that is greater than 1, indicating that the threaded portion includes a length that is greater than that of the unthreaded portion. As such, an inverse of the first ratio 612, which indicates the length of the unthreaded portion relative to the length of the threaded portion, is less than 1. However, the presence of the unthreaded portion causes such the inverse of the first ratio 612 to be greater than 0, such as greater than 0.1, to provide sufficient stability for the retainers 602, 604. Additionally, each of the retainers 602, 604 includes a second ratio 614 that is greater than 1, indicating that the threaded portion has a diameter that is greater than that of the unthreaded portion. Consequently, a shoulder may transition between the threaded portion and the unthreaded portion. Meanwhile, the prior art retainers 606, 608 do not include unthreaded portions and therefore do not include either of the ratios 612, 614. Further, an inverse of the ratios 612, 614 would be approximately 0 for the prior art retainers 606, 608, because these retainers lack an unthreaded portion.

Moreover, the first distance 616, the third ratio 618, and the overall lateral surface area 620 of each of the retainers 602, 604 are each substantially different than that of the prior art retainers 606, 608 because of unthreaded portions. With respect to the first distance 616, the unthreaded portion creates a shoulder transitioning between the threaded portion and the unthreaded portion such that the threaded portion ends or terminates at the shoulder (e.g., rather than at an exterior surface). That is, a downstream end of the threads is disposed within the bounds of the retainer (i.e., terminates within the length of the retainer). At the same time, the center of gravity shifts toward the shoulder. Thus, the first distance 616 of each of the retainers 602, 604 is less than the first distance 616 of each of the prior art retainers 606, 608. For instance, the first distance 616 of each of the retainers 602, 604 may be less than 1.29 inches, which is the lesser of the first distances 616 of the retainers 602, 604.

With respect to the third ratio 618, the unthreaded portion moves the center of gravity toward being equidistant to an exterior/downstream surface, which faces toward an exterior of the reciprocating pump and away from a pumping chamber, and to an interior/upstream surface, which faces toward a pumping chamber and away from an exterior of the reciprocating pump. As such, the third ratio 618 indicates that the center of gravity for the retainers 602, 604 is more relatively internally positioned than the center of gravity of the prior art retainers 606, 608, insofar as "relatively internally" is used to describe a distance from the center of gravity to the internal surface relative to the distance from the center of gravity to the exterior surface. Indeed, third ratio 618 for the retainers 602, 604 is closer to one. Thus, the third ratio 618 of each of the retainers 602, 604 is greater than 0.79, which is the greater of the third ratios 618 of the prior art retainers 606, 608.

Moreover, because each of the retainers 602, 604 includes an unthreaded portion in addition to the threaded portion, the lateral surface area 620 of each of the retainers 602, 604 is greater than the lateral surface area 620 of the prior art retainers 606, 608. For example, the lateral surface area 620 of each of the retainers 602, 604 is greater than 72.72 square inches, which is the greater of the lateral surface areas 620 of the prior art retainers 606, 608.

FIG. 9 is a table 650 illustrating the first ratio 612, the second ratio 614, the first distance 616, the third ratio 618, and the lateral surface area 620, as measured using centimeters, of the first retainer 602, the second retainer 604, the first prior art retainer 606, and the second prior art retainer 608. As indicated in the table 650, the first distance 616 of each of the retainers 602, 604 is less than 3.28 centimeters, which is the greater of the first distances 616 of the prior art retainers 606, 608. Moreover, the lateral surface area 620 of each of the retainers 602, 604 is greater than 469.16 square centimeters, which is the greater of the lateral surface areas 620 of the prior art retainers 606, 608. The relatively lower first distance 616 and relatively greater lateral surface areas 620 of the retainers 602, 604 provides the retainers 602, 604 with sufficient stability to remain secured to the threaded wall.

While the disclosure has been illustrated and described in detail and with reference to specific embodiments thereof, it is nevertheless not intended to be limited to the details shown, since it will be apparent that various modifications and structural changes may be made therein without departing from the scope and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

Similarly, it is intended that the present disclosure cover the modifications and variations of this disclosure that come within the scope of the appended claims and their equivalents. For example, it is to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present disclosure to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the disclosure.

Finally, when used herein, the term "comprises" and its derivations (such as "comprising", etc.) should not be understood in an excluding sense, that is, these terms should not be interpreted as excluding the possibility that what is described and defined may include further elements, steps, etc. Meanwhile, when used herein, the term "approximately" and terms of its family (such as "approximate," etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the terms "about" and "around" and "substantially."

What is claimed is:

1. A fluid end, comprising:

a housing having a bore configured to receive a closure element, the bore extending through the housing along an axis and including a wall comprising first threads; and a retainer configured to be positioned in the bore of the housing, wherein the retainer comprises:

a threaded portion with second threads configured to engage with the first threads of the wall of the housing, wherein the threaded portion extends from an interior surface to a shoulder, the interior surface being configured to lead insertion of the retainer into the bore of the housing; and an unthreaded portion extending from the shoulder to an exterior surface, opposite the interior surface, such that a first distance between a center of gravity of the retainer and the exterior surface is within 10% of a second distance between the center of gravity and the interior surface to provide sufficient rigidity of the retainer to withstand rotation relative to the wall of the fluid end while the second threads of the threaded portion are engaged with the first threads of the wall.

2. The fluid end of claim 1, wherein the wall of the housing extends a length along the axis extending through the bore.

3. The fluid end of claim 1, wherein the unthreaded portion includes a smaller diameter than a diameter of the threaded portion.

4. The fluid end of claim 3, wherein the threaded portion extends a first length and comprises a first lateral surface area that is the first length times a circumference of the threaded portion, the unthreaded portion extends a second length and comprises a second lateral surface area that is the second length times a circumference of the unthreaded portion, and the first lateral surface area of the threaded portion plus the second lateral surface area of the unthreaded portion is greater than 531 square centimeters.

5. The fluid end of claim 4, wherein a ratio of the second length relative to the first length is greater than 0.1.

6. The fluid end of claim 1, comprising a reciprocating element with a reciprocating element diameter, wherein a length of the wall of the housing in centimeters plus a ratio of a diameter of the wall in centimeters relative to the reciprocating element diameter in centimeters is greater than 10.31.

7. The fluid end of claim 1, wherein the bore comprises an access bore, and the closure element is configured to block fluid flow through the access bore during operation of the fluid end to pressurize fluid.

8. A retainer of a fluid end, the retainer comprising:

a threaded portion configured to engage with threads of a wall of the fluid end, the wall defining a bore in which the retainer is configured to be inserted, the threaded portion extending from an interior surface to a shoulder of the retainer, and the interior surface is configured to lead insertion of the retainer into the bore; and an unthreaded portion extending from the shoulder to an exterior surface, opposite the interior surface, to establish a center of gravity of the retainer, wherein a first distance between the center of gravity and the exterior surface is within 10% of a second distance between the center of gravity and the interior surface to provide sufficient rigidity of the retainer to withstand rotation relative to the wall of the fluid end while the threaded portion is engaged with the threads of the wall.

9. The retainer of claim 8, wherein a ratio of a first length of the unthreaded portion relative to a second length of the threaded portion is less than 1.

10. The retainer of claim 8, wherein the threaded portion comprises a first diameter and the unthreaded portion comprises a second diameter that is less than the first diameter to form the shoulder between the threaded portion and the unthreaded portion.

11. The retainer of claim 10, wherein a ratio of the first diameter of the threaded portion relative to the second diameter of the unthreaded portion is greater than 1.1.

12. The retainer of claim 10, wherein the unthreaded portion extends from the threaded portion, and a distance from the center of gravity of the retainer to the shoulder is less than 3.28 centimeters.

13. The retainer of claim 8, wherein a ratio of a first distance between the center of gravity of the retainer and the exterior surface of the retainer relative to a second distance between the center of gravity and the interior surface of the retainer is between 0.95 and 0.97.

14. The retainer of claim 8, wherein a lateral surface area of the retainer is greater than 469.16 square centimeters.

15. A fluid end of a reciprocating pump, the fluid end comprising:

a housing having a bore extending along an axis from a pumping chamber of the housing to an external surface of the housing, the bore comprising a wall with threads configured to engage a retainer installed in the bore, wherein the wall comprises a first diameter and extends a length along the axis; and a reciprocating element extending along the axis and comprising a second diameter, wherein the length of the wall in centimeters plus a ratio of the first diameter of the wall in centimeters relative to the second diameter of the reciprocating element in centimeters is greater than 10.31.

16. The fluid end of claim 15, comprising an additional bore offset from the bore along an additional axis that is perpendicular to the axis of extension of the bore and of the additional bore, wherein a first center of the bore and a second center of the additional bore are offset by a distance along the additional axis, a ratio of the distance relative to the length of the wall being less than 2.96.

17. The fluid end of claim 16, comprising a plurality of holes offset from one another along a supplemental axis perpendicular to the axis along which the bore extends and to the additional axis, wherein each hole of the plurality of holes is configured to receive a respective coupler that connects the fluid end to a power end of the reciprocating pump, and centers of adjacent holes of the plurality of holes are separated by an additional distance along the supplemental axis, a ratio of the additional distance relative to the length of the wall being less than 3.55.

18. The fluid end of claim 15, comprising the retainer, wherein the retainer comprises a threaded portion configured to engage the threads of the wall, and the retainer comprises an unthreaded portion having a smaller diameter than a diameter of the threaded portion.

19. The fluid end of claim 15, wherein a lateral surface area of the wall is greater than 531 square centimeters.

20. The fluid end of claim 15, comprising the retainer, wherein the retainer comprises a threaded portion configured to engage the threads of the wall, and the retainer does not comprise an unthreaded portion extending from the threaded portion.

* * * * *